US007287516B2

(12) United States Patent
Elliot et al.

(10) Patent No.: US 7,287,516 B2
(45) Date of Patent: Oct. 30, 2007

(54) PUMP CONTROL SYSTEM

(75) Inventors: Christopher M. Elliot, Apex, NC (US); Scott R. Schuricht, Edwards, IL (US); Travis E. Barnes, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 145 days.

(21) Appl. No.: 11/192,037

(22) Filed: Jul. 29, 2005

(65) Prior Publication Data

US 2007/0023009 A1 Feb. 1, 2007

(51) Int. Cl.
*F02M 37/04* (2006.01)
*F02M 37/08* (2006.01)

(52) U.S. Cl. ..... 123/500; 123/486

(58) Field of Classification Search ..... 123/495, 123/500–504, 486, 480, 496, 458; 417/26
See application file for complete search history.

(56) References Cited

U.S. PATENT DOCUMENTS 6,227,167 B1 5/2001 Smith et al.
6,311,674 B1 11/2001 Igashira et al.
6,318,343 B1 * 11/2001 Nakagawa et al. ..... 123/500
6,367,452 B1 * 4/2002 Shima et al. ..... 123/457
6,446,610 B1 * 9/2002 Mazet ..... 123/497
6,609,500 B2 8/2003 Ricco et al.
6,745,751 B2 * 6/2004 Seo et al. ..... 123/456
6,840,220 B2 1/2005 Yomogida et al.
6,840,224 B2 * 1/2005 Tanabe et al. ..... 123/458
6,948,480 B2 * 9/2005 Eser et al. ..... 123/495
6,971,368 B2 * 12/2005 Uchiyama ..... 123/359
2003/0121501 A1 7/2003 Barnes et al.
2004/0000289 A1 * 1/2004 Seo et al. ..... 123/447
2004/0020465 A1 * 2/2004 Tanabe et al. ..... 123/447
2005/0103312 A1 * 5/2005 Uchiyama ..... 123/457
2005/0257775 A1 * 11/2005 Kojima ..... 123/458
2006/0081219 A1 * 4/2006 Nomura et al. ..... 123/458

FOREIGN PATENT DOCUMENTS

EP 0757 169 7/1996

* cited by examiner

*Primary Examiner*—Mahmoud Gimie
(74) *Attorney, Agent, or Firm*—Finnegan, Henderson, Farabow, Garrett & Dunner

(57) ABSTRACT

A pump for a fuel system is disclosed. The pump has a housing defining at least one pumping chamber, and a plunger. The plunger is movable to draw a fluid into and displace the fluid from the at least one pumping chamber. The pump also has a metering valve and a controller. The metering valve has a valve element movable to selectively meter fluid drawn into the at least one pumping chamber. The controller is configured to receive an indication of a desired discharge characteristic and reference a first map to determine an inlet opening area corresponding to the desired discharge characteristic. The controller is also configured to reference a second map to determine a position of the metering valve corresponding to the determined inlet opening area, and to send a control signal to the metering valve indicative of the determined position.

22 Claims, 2 Drawing Sheets

PUMP CONTROL SYSTEM

TECHNICAL FIELD

The present disclosure relates generally to a control system, and more particularly to a control system for a pump.

BACKGROUND

A variable discharge fuel pump is utilized to maintain a pressurized fuel supply for a plurality of fuel injectors in a common rail fuel system. For example, U.S. Pat. No. 6,311,674 (the '674 patent) to Igashira et al. teaches a fuel pump having a driveshaft and three plungers radially oriented around the driveshaft. As the driveshaft rotates, the plungers reciprocate inward toward the driveshaft to draw fuel past a metering valve and through an inlet port of the pump. As the plungers are displaced away from the driveshaft, fuel is discharged through an outlet port of the pump to a common fuel rail.

The pump of the '674 patent is inlet regulated by controlling movement of the metering valve. Specifically, in response to a desired discharge flow rate of fuel and a desired rail pressure, a current map is referenced to determine a current signal sent to the metering valve. For example, as the desired quantity of fuel delivered to the common fuel rail or the desired fuel pressure within the common fuel rail increases, a higher current level is determined from the current map and a corresponding signal sent to the metering valve to increase the opening area of the metering valve. The increased opening area allows for a greater amount of fuel to be drawn into the pump and subsequently discharged to the common fuel rail.

Although the pump and control strategy of the '674 patent may provide a sufficient flow of pressurized fuel to the common fuel rail, it may be limited, and lack a signal-failure provision. In particular, because the control strategy of the '674 patent utilizes a single current map that is dependent on desired flows and pressures, the control strategy may be applicable only to a particular pump and a particular metering valve. In other words, if either a different pump or metering valve (i.e., a pump with a different displacement or a valve with a different opening area-to-current input relationship) was implemented into a particular application, a completely new control strategy would be required to provide the desired fuel flows. Further, the control strategy of the '674 patent does not provide for the condition when transmission of the current signal to the pump is interrupted.

The disclosed pump control system is directed to overcoming one or more of the problems set forth above.

SUMMARY OF THE INVENTION

In one aspect, the present disclosure is directed to a pump. The pump includes a housing defining at least one pumping chamber, and a plunger slidably disposed within the at least one pumping chamber. The plunger is movable between a first and a second spaced apart end position to draw a fluid into the at least one pumping chamber and displace the fluid from the at least one pumping chamber. The pump also includes a metering valve disposed at an inlet of the at least one pumping chamber, and a controller in communication with the metering valve. The metering valve has a valve element movable to selectively meter the fluid drawn into the at least one pumping chamber. The controller is configured to receive an indication of a desired discharge characteristic and to reference a first map stored in a memory of the controller to determine an inlet opening area corresponding to the desired discharge characteristic. The controller is further configured to reference a second map stored in the memory of the controller to determine a position of the metering valve corresponding to the determined inlet opening area, and to send a control signal to the metering valve indicative of the determined position.

In another aspect, the present disclosure is directed to a method of operating a pump. The method includes moving a plunger within a pumping chamber between a first and a second spaced apart end position to draw a fluid into the pumping chamber and displace the fluid from the pumping chamber. The method also includes receiving an indication of a desired discharge characteristic and determining an inlet opening area associated with the pumping chamber and corresponding to the desired discharge characteristic. The method further includes determining a position of a metering valve corresponding to the determined inlet opening area, and sending a control signal indicative of the determined position to a metering valve associated with an inlet of the pumping chamber.

DETAILED DESCRIPTION

Figure 1:
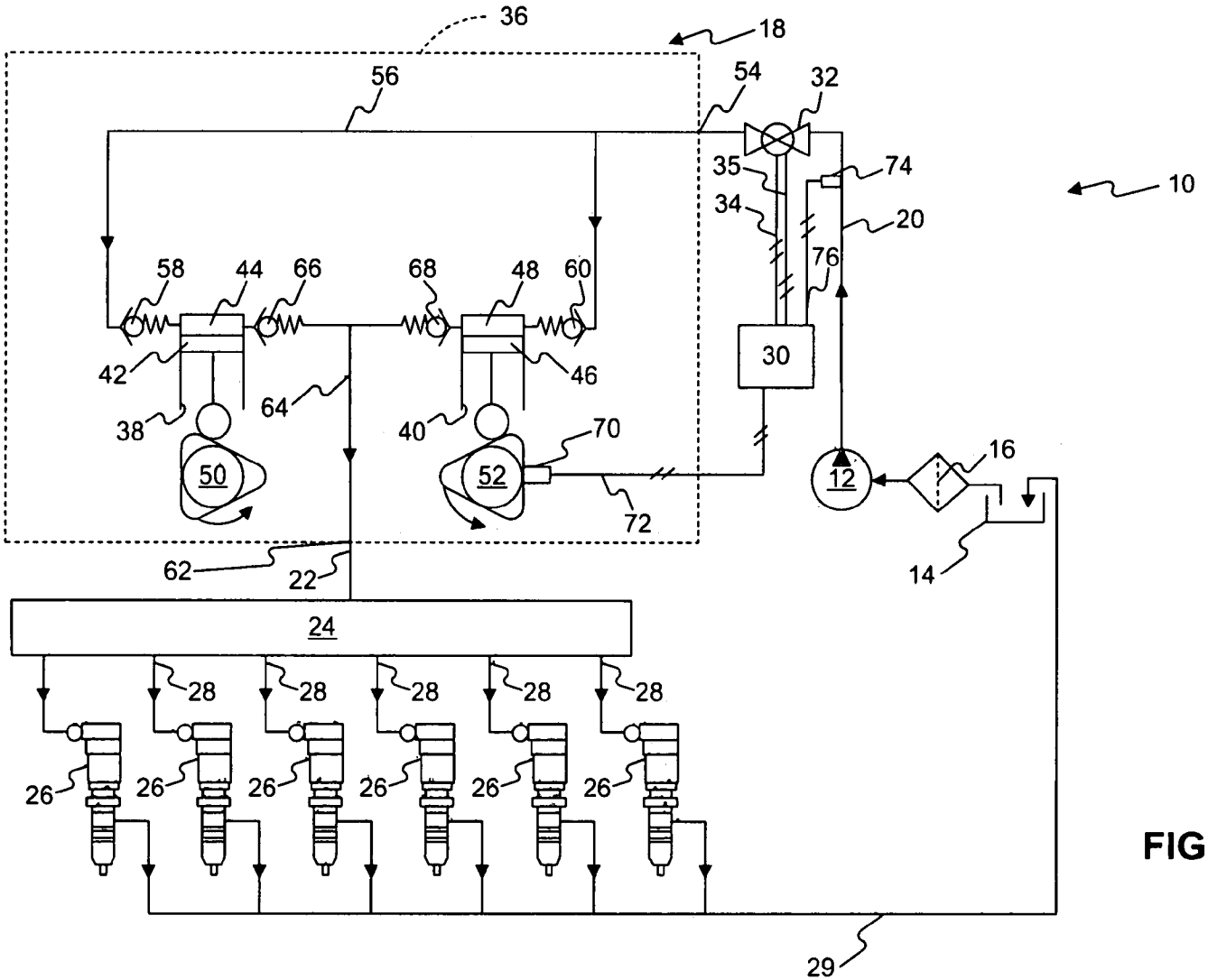
FIG. 1 is a schematic illustration of a common rail fuel system according to an exemplary embodiment of the present disclosure.

Referring to FIG. 1, a fuel system 10 may include a fuel transfer pump 12 that transfers fuel from a low-pressure reservoir 14 through one or more filtration devices 16 to a high-pressure pump 18 via a fluid passageway 20. High-pressure pump 18 may pressurize the fuel and direct the pressurized fuel through a fluid passageway 22 to a fuel rail 24 that is in fluid communication with a plurality of fuel injectors 26 via a plurality of fluid passageways 28. Fuel injectors 26 may be fluidly connected to low-pressure reservoir 14 via a leak return passageway 29. An electronic control module 30 may be in communication via a primary communication line 34 and a backup communication line 35 with an actuator 32 connected to high-pressure pump 18. Electronic control module 30 may also be in communication with individual fuel injectors 26 via additional communication lines (not shown).

High-pressure pump 18 may include a housing 36 defining a first and second barrel 38, 40. High-pressure pump 18 may also include a first plunger 42 slidably disposed within first barrel 38. First barrel 38 and first plunger 42 together may define a first pumping chamber 44. High-pressure pump 18 may further include a second plunger 46 slidably disposed within second barrel 40. Second barrel 40 and second plunger 46 together may define a second pumping chamber 48. It is contemplated that additional pumping chambers may be included within high-pressure pump 18.

A first and second driver 50, 52 may be operably connected to first and second plungers 42, 46, respectively. First and second drivers 50, 52 may include any means for driving first and second plungers 42, 46 such as, for example, a cam, a solenoid actuator, a piezo actuator, a hydraulic actuator, a motor, or any other driving means known in the art. A rotation of first driver 50 may result in a corresponding reciprocation of first plunger 42, and a rotation of second driver 52 may result in a corresponding reciprocation of second plunger 46. First and second drivers 50, 52 may be positioned relative to each other such that first and second plungers 42, 46 are caused to reciprocate out of phase with one another. First and second drivers 50, 52 may each include three lobes such that one rotation of a pump shaft (not shown) connected to first and second drivers 50, 52 may result in six pumping strokes. Alternately, first and second drivers 50, 52 may include a different number of lobes rotated at a rate such that pumping activity is synchronized to fuel injection activity. It is contemplated that a single driver may alternatively be configured to drive both first and second plungers 42, 46.

High-pressure pump 18 may include an inlet 54 fluidly connecting high-pressure pump 18 to fluid passageway 20. High-pressure pump 18 may also include a low-pressure gallery 56 in fluid communication with inlet 54 and in selective communication with first and second pumping chambers 44, 48. A first inlet check valve 58 may be disposed between low-pressure gallery 56 and first pumping chamber 44 and may be configured to allow a flow of low-pressure fluid from low-pressure gallery 56 to first pumping chamber 44. A second inlet check valve 60 may be disposed between low-pressure gallery 56 and second pumping chamber 48 and may be configured to allow a flow of low-pressure fluid from low-pressure gallery 56 to second pumping chamber 48.

High-pressure pump 18 may also include an outlet 62 fluidly connecting high-pressure pump 18 to fluid passageway 22. High-pressure pump 18 may include a high-pressure gallery 64 in selective fluid communication with first and second pumping chambers 44, 48 and outlet 62. A first outlet check valve 66 may be disposed between first pumping chamber 44 and high-pressure gallery 64 and may be configured to allow a flow of fluid from first pumping chamber 44 to high-pressure gallery 64. A second outlet check valve 68 may be disposed between second pumping chamber 48 and high-pressure gallery 64 and may be configured to allow a flow of fluid from second pumping chamber 48 to high-pressure gallery 64.

Control signals generated by electronic control module 30 and directed to actuator 32 may determine when and how much fuel is drawn into and pumped by high-pressure pump 18 into fuel rail 24, thereby affecting the discharge flow rate of fuel into fuel rail 24 and the pressure of the fuel in fuel rail 24. Control signals generated by electronic control module 30 directed to fuel injectors 26 may determine the actuation timing, pressure, and duration of fuel injectors 26.

Electronic control module 30 may generate the control signals in response to one or more input. In particular, electronic control module 30 may be in communication with a speed sensor 70 via a communication line 72, and with a pressure sensor 74 via a communication line 76 to receive an indication of a drive speed of high-pressure pump 18 and an inlet pressure of the fuel directed into high-pressure pump 19, respectively. It is contemplated that electronic control module 30 may be in communication with additional sensing devices such as, for example, a fuel rail pressure sensor, a flow meter, and other sensing devices known in the art. Electronic control module 30 may also receive an indication of a desired pump discharge characteristic such as a flow rate or a discharge pressure. As described in greater detail below, electronic control module 30 may then energize actuator 32 in response to the input and the desired pump discharge characteristics according to one or more relationships stored in a memory of electronic control module 30.

Electronic control module 30 may embody a single microprocessor or multiple microprocessors that include a means for controlling an operation of actuator 32. Numerous commercially available microprocessors can be configured to perform the functions of electronic control module 30. It should be appreciated that electronic control module 30 could readily embody a general work machine or engine microprocessor capable of controlling numerous work machine or engine functions. Electronic control module 30 may include all the components necessary to perform the required system control such as, for example, a memory, a secondary storage device, and a processor, such as a central processing unit. One skilled in the art will appreciate that electronic control module 30 can contain additional or different components. Associated with electronic control module 30 may be various other known circuits such as, for example, power supply circuitry, signal conditioning circuitry, and solenoid driver circuitry, among others.

Actuator 32 may embody a metering valve mechanism configured to selectively restrict a flow of fuel into high-pressure pump 18. In one example, actuator 32 may include a rotary-type valve mechanism rotatable between a first angular position at which fuel is blocked from high-pressure pump 18, and a second angular position at which the flow of fuel into high-pressure pump 18 is substantially unrestricted. The angular position of the rotary valve mechanism between the first and second positions may affect a flow rate of fuel into high-pressure pump 18. It is contemplated that actuator 32 may alternatively include a linear-type or another suitable type of valve mechanism known in the art.

Figure 2:
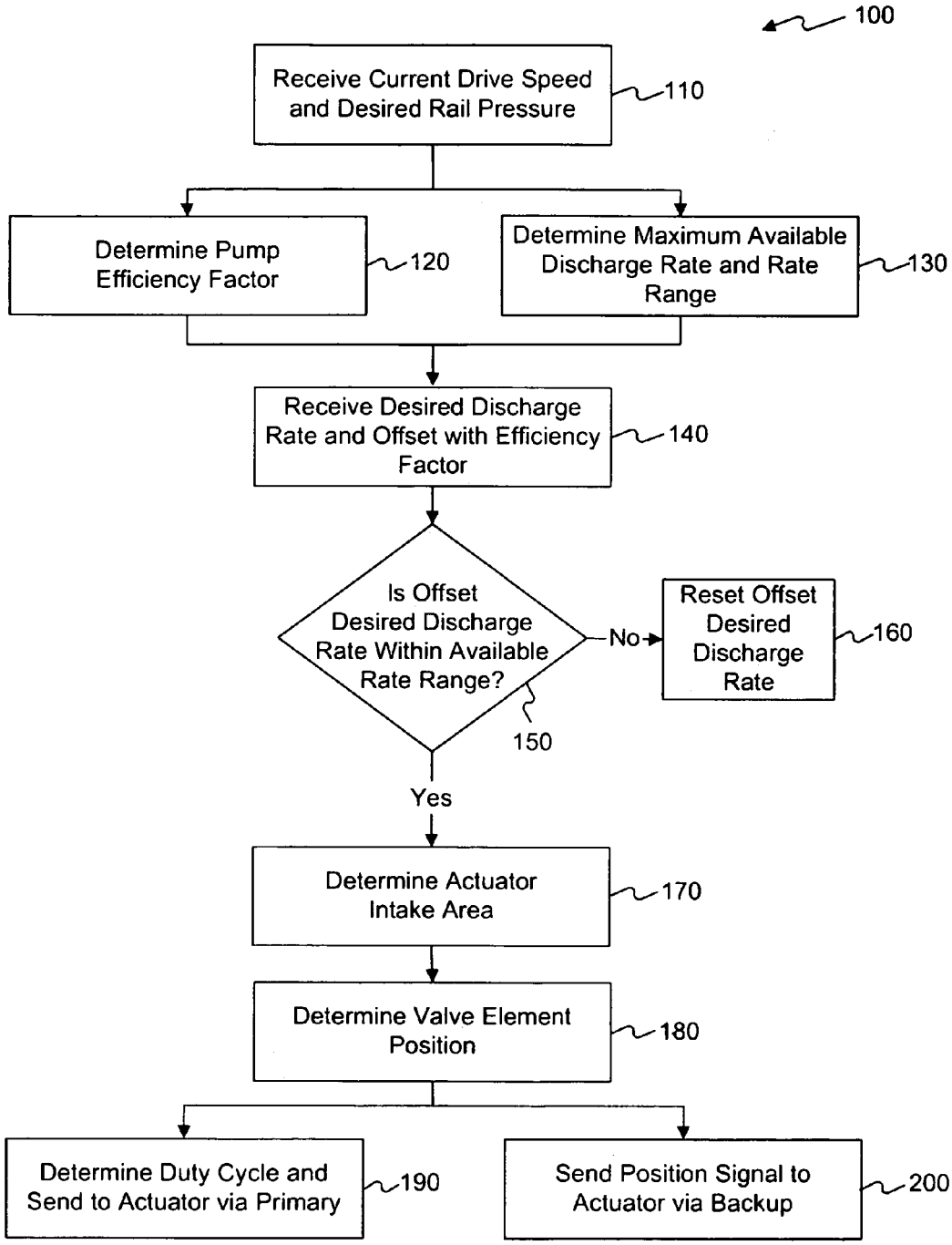
FIG. 2 is a flow chart depicting an exemplary method of operating the fuel system of claim 1.

FIG. 2 illustrates a flowchart 100 describing a method of operating high-pressure pump 18. FIG. 2 will be discussed in the following section to further illustrate the disclosed system and its operation.

INDUSTRIAL APPLICABILITY

The disclosed pump finds potential application in any fluid system where it is desirous to provide reliable discharge from a pump, while maintaining component flexibility. The disclosed pump finds particular applicability in fuel injection systems, especially common rail fuel injection systems. One skilled in the art will recognize that the disclosed pump could be utilized in relation to other fluid systems that may or may not be associated with an internal combustion engine. For example, the disclosed pump could be utilized in relation to fluid systems for internal combustion engines that use a hydraulic medium, such as engine lubricating oil. The fluid systems may be used to actuate various sub-systems such as, for example, hydraulically-actuated fuel injectors or gas exchange valves used for engine braking. A pump according to the present disclosure could also be substituted for a pair of unit pumps in other fuel systems, including those that do not include a common fuel rail.

Referring to FIG. 1, when fuel system 10 is in operation, first and second drivers 50, 52 may rotate causing first and second plungers 42, 46 to reciprocate within respective first and second barrels 38, 40, out of phase with one another. When first plunger 42 moves through the intake stroke, second plunger 46 may move through the pumping stroke.

During the intake stroke of first plunger 42, fuel may be drawn into first pumping chamber 44 via actuator 32. As first plunger 42 begins the pumping stroke, fuel pressure may cause first inlet check valve 58 to close and allow displaced fuel to flow from first pumping chamber 44 through first outlet check valve 66 to high-pressure gallery 64. After first plunger 42 completes the pumping stroke and begins moving in the opposite direction during the intake stroke, second plunger 46 may switch modes from filling to pumping. Second plunger 46 may then complete a pumping stroke similar to that described above with respect to first plunger 42. When it is desirous to modify the discharge of fuel from high-pressure pump 18, actuator 32 may be energized to change an inlet opening area of high-pressure pump 18.

One skilled in the art will appreciate that the timing at and the extent to which actuator 32 is energized may affect what amount of fuel is drawn into first pumping chamber 44 and displaced by first plunger 42 into high-pressure gallery 64. For example, by energizing actuator 32 to restrict the flow of fuel into first pumping chamber 44 during an intake stroke of first plunger 42, less fuel may flow into first pumping chamber 44. Conversely, by energizing actuator 32 to reduce the restriction during the intake stroke, more fuel may flow into first pumping chamber 44. The amount of fuel within first pumping chamber 44 at the start of the compression stroke may correspond to the amount of fuel displaced from first pumping chamber 44 and the resulting pressure within fuel rail 24. This operation serves as a means by which pressure can be maintained and controlled in fuel rail 24. As noted in the previous section, control of actuator 32 may be provided by signals received from electronic control module 30 over primary and backup communication lines 34, 35.

The process of determining the control signals for actuator 32 is illustrated in FIG. 2. During a pumping event, electronic control module 30 may receive an indication of a current pump drive speed and a desired rail pressure (Step 110). Once this input has been received, electronic control module 30 may reference the current pump drive speed and desired rail pressure with a first 3-D map stored in the memory of electronic control module 30 to determine an efficiency offset factor (Step 120) that accommodates losses associated with high-pressure pump 18 at various operating conditions. At about the same time, electronic control module 30 may also reference the current pump drive speed and desired rail pressure with a second 3-D map to determine a maximum available discharge rate for high-pressure pump 18 and an associated rate range extending from zero output to the maximum available output rate (Step 130). For the purposes of this disclosure, the term map may include a collection of data or equations that represents the intended relationship.

Also during the pumping event, electronic control module 30 may receive an indication of a desired discharge rate and offset the desired discharge rate by the efficiency factor determined in step 120 above (Step 140). Electronic control module 30 may then compare this offset desired discharge rate to the available rate range determined in step 130 (Step 150). If the offset desired discharge rate falls outside of the available rate range (e.g., is greater than the maximum output rate or less than zero), the offset desired discharge rate may be reset to a value within the available rate range (Step 160). In one example, if the offset desired discharge rate exceeds the available rate range, the offset desired discharge rate may be reset to the maximum available rate. In the same example, if the offset desired discharge rate is less than zero, the offset desired discharge rate may be reset to zero.

Electronic control module 30 may receive input from pressure sensor 74 to determine an inlet flow area of actuator 32 that results in the desired discharge rate (Step 170). In particular, electronic control module 30 may receive an indication of a current intake fuel pressure and reference this pressure input and the offset desired discharge rate with a third 3-D map to determine an appropriate inlet flow area of actuator 32. This determined inlet flow area may then be referenced with a 2-D map to determine a valve element position of actuator 32 that results in the determined inlet flow area (Step 180).

Once the appropriate valve element position has been determined, two signals indicative of this position may be generated and simultaneously sent to actuator 32. In particular, the valve element position information may be converted to a pump duty cycle and sent to actuator 32 via primary communication line 34 (Step 190), and simultaneously sent to actuator 32 (without conversion to a pump duty cycle) via backup communication line 35 (Step 200). The valve element of actuator 32 may then move to appropriately open or close the inlet area of high-pressure pump 18, thereby affecting discharge flow control.

Because electronic control module 30 utilizes separate area flow and actuator position maps, the flexibility of fuel system 10 may be improved, as compared to a fuel system having a single control map. In particular, if it is desired to replace high-pressure pump 18 with a different pump, only the third 3-D map need be swapped within the memory of electronic control module 30. In this situation, all other maps and control routines may remain essentially unchanged. Similarly, if it is desired to replace actuator 32 with a different actuator, only the 2-D map need by swapped with the memory of electronic control module 30. This increased flexibility may result in less cost and complexity associated with component changes of fuel system 10.

The backup signal strategy of electronic control module 30 may increase the reliability of fuel system 10. In particular, because electronic control module 30 sends redundant information to actuator 32 to control the angular position of the valve element of actuator 32, the likelihood of the information reaching actuator 32 is increased. For example, should primary communication line 34 be severed or otherwise rendered ineffectual, the valve position of actuator 32 may still be controlled by the duty cycle information passed to actuator 32 via backup communication line 35.

It will be apparent to those skilled in the art that various modifications and variations can be made to the pump control system of the present disclosure. Other embodiments of the pump control system will be apparent to those skilled in the art from consideration of the specification and practice of the pump control system disclosed herein. It is intended that the specification and examples be considered as exemplary only, with a true scope of the disclosure being indicated by the following claims and their equivalents.

What is claimed is:

1. A pump, comprising:

a housing defining at least one pumping chamber;

a plunger slidably disposed within the at least one pumping chamber and movable between a first and a second spaced apart end position to draw a fluid into the at least one pumping chamber and displace the fluid from the at least one pumping chamber;

a metering valve disposed at an inlet of the at least one pumping chamber, the metering valve having a valve element movable to selectively meter fluid drawn into the at least one pumping chamber; and a controller in communication with the metering valve and configured to:

receive an indication of a desired discharge characteristic;

reference a first map stored in a memory of the controller to determine an inlet opening area corresponding to the desired discharge characteristic;

reference a second map stored in the memory of the controller to determine a position of the metering valve corresponding to the determined inlet opening area; and send a control signal to the metering valve indicative of the determined position.

2. The pump of claim 1, wherein the desired discharge characteristic is a flow rate.

3. The pump of claim 1, wherein the controller is further configured to:

receive an input indicative of a current drive speed;

receive an input indicative of a desired discharge pressure;

reference a third map stored in the controller to determine an efficiency factor corresponding to the current drive speed and desired discharge pressure; and offset the desired discharge characteristic by the determined efficiency factor.

4. The pump of claim 3, wherein the controller is further configured to:

reference a fourth map to determine an available discharge range corresponding to the current drive speed and the desired discharge pressure;

determine if the desired discharge characteristic is outside of the available discharge range; and limit the control signal to a value corresponding to a discharge within the available discharge range when the desired discharge characteristic is outside of the available discharge range.

5. The pump of claim 3, wherein:

the controller is further configured to receive an indication of a current inlet pressure; and the inlet opening area is further determined in response to the current inlet pressure.

6. The pump of claim 1, wherein the controller is further configured to send the control signal to the metering valve through a primary communication line and a backup communication line.

7. The pump of claim 6, wherein the control signal sent to the metering valve through one of the primary and backup communication lines is first converted to a duty cycle.

8. The pump of claim 1, wherein:

the at least one pumping chamber is a first pumping chamber;

the housing further defines a second pumping chamber;

the plunger is a first plunger;

the pump includes a second plunger slidably disposed within the second pumping chamber and movable between a first and a second spaced apart end position to draw a fluid into the second pumping chamber and displace the fluid from the second pumping chamber; and the metering valve is common to the first and second pumping chambers and configured to selectively meter fluid through the inlet to both the first and second pumping chambers.

9. A method of operating a pump, comprising:

moving at least one plunger within a pumping chamber between a first and a second spaced apart end position to draw a fluid into the pumping chamber and displace the fluid from the pumping chamber;

receiving an indication of a desired discharge characteristic;

determining an inlet opening area associated with the pumping chamber and corresponding to the desired discharge characteristic;

determining a position of a metering valve corresponding to the determined inlet opening area; and sending a control signal indicative of the determined position to a metering valve associated with an inlet of the pumping chamber.

10. The method of claim 9, wherein the desired discharge characteristic is a flow rate.

11. The method of claim 9, further including:

receiving an input indicative of a current drive speed;

receiving an input indicative of a desired discharge pressure;

determining an efficiency factor corresponding to the current drive speed and the desired discharge pressure; and offsetting the desired discharge characteristic by the determined efficiency factor.

12. The method of claim 11, further including:

determining an available discharge range corresponding to the current drive speed and the desired discharge pressure;

determining if the desired discharge characteristic is outside of the available discharge range; and limiting the control signal to a value corresponding to a discharge within the available discharge range when the desired discharge characteristic is outside of the available discharge range.

13. The method of claim 11, further including receiving an indication of a current inlet pressure, wherein the determined inlet opening area further corresponds to the current inlet pressure.

14. The method of claim 9, wherein sending includes sending the control signal to a metering valve via a primary communication line and a backup communication line.

15. The method of claim 14, further including first converting the control signal sent via one of the primary and backup communication lines to a duty cycle.

16. A fuel system, comprising:

a supply of fuel;

a common fuel rail;

a plurality of fuel injectors in communication with the common fuel rail; and a pump configured to pressurize the fuel and direct a stream of the pressurized fuel to the common fuel rail, the pump including:

a housing defining a first pumping chamber and a second pumping chamber;

a first plunger slidably disposed within the first pumping chamber and movable between a first and a second spaced apart end position to draw fuel into the first pumping chamber and displace the fuel from the first pumping chamber;

a second plunger slidably disposed within the second pumping chamber and movable between a first and a second spaced apart end position to draw fuel into the second chamber and displace the fuel from the second pumping chamber;

a metering valve disposed at an inlet of the first and second pumping chambers, the metering valve having a valve element movable to selectively meter fuel drawn into the first and second pumping chambers; and a controller in communication with the metering valve and configured to:

receive an indication of an inlet fuel pressure;

receive an indication of a desired discharge rate of fuel;

reference a first map stored in a memory of the controller to determine an inlet opening area corresponding to the desired discharge rate of fuel and the inlet fuel pressure;

reference a second map stored in the memory of the controller to determine a position of the metering valve corresponding to the determined inlet opening area; and send a control signal to the metering valve indicative of the determined position.

17. The fuel system of claim 16, wherein the controller is further configured to:

receive an input indicative of a current drive speed;

receive an input indicative of a desired discharge pressure;

reference a third map stored in the controller to determine an efficiency factor corresponding to the current drive speed and desired discharge pressure; and offset the desired discharge characteristic by the determined efficiency factor.

18. The fuel system of claim 17, wherein the controller is further configured to:

reference a fourth map to determine an available discharge range corresponding to the current drive speed and the desired discharge pressure;

determine if the desired discharge characteristic is outside of the available discharge range; and limit the control signal to a value corresponding to a discharge within the available discharge range when the desired discharge characteristic is outside of the available discharge range.

19. The fuel system of claim 16, wherein the controller is further configured to send the control signal to the metering valve through a primary communication line and a backup communication line.

20. The fuel system of claim 19, wherein the control signal sent to the metering valve through one of the primary and backup communication lines is first converted to a duty cycle.

21. The method of claim 9, wherein the determining of the inlet opening area and the determining of the position of the metering valve includes referencing at least one map.

22. The method of claim 21, wherein:

the determining of the inlet opening area includes referencing a first map; and the determining of the position of the metering valve includes referencing a second map.

* * * * *